United States Patent [19]

Fitzgibbon

[11] 4,228,739

[45] Oct. 21, 1980

[54] MOTORIZED RAILWAY TRUCK ARTICULATED SHAFT HOUSING

[75] Inventor: Thomas F. Fitzgibbon, Palos Verdes Estates, Calif.

[73] Assignee: The Garrett Corporation, Los Angeles, Calif.

[21] Appl. No.: 812,046

[22] Filed: Jul. 1, 1977

[51] Int. Cl.[3] ..... B61C 3/00; B61C 9/50; F16C 1/06; F16F 15/10

[52] U.S. Cl. ..... 105/136; 64/1 C; 74/609; 105/140; 277/30; 277/100; 308/36.1; 403/286

[58] Field of Search ..... 64/1 C; 74/609; 105/131, 133, 134, 135, 136, 137, 138, 139, 140; 277/30, 100; 403/286, 293; 308/36.1

[56] References Cited

U.S. PATENT DOCUMENTS

| | | | |
|---|---|---|---|
| 1,063,389 | 6/1913 | Robbins | 277/100 |
| 1,723,720 | 8/1929 | Buchli | 105/133 |
| 1,813,140 | 7/1931 | Bethel | 105/139 |
| 2,084,891 | 6/1937 | Cease | 105/136 |
| 2,847,837 | 8/1958 | Baker | 277/30 X |
| 3,239,232 | 3/1966 | Andresen | 277/30 X |
| 3,468,389 | 9/1969 | Nelson | 105/136 X |
| 3,727,483 | 4/1973 | Hanson et al. | 105/140 X |
| 3,797,329 | 3/1974 | Quirk | 74/609 |
| 3,841,228 | 10/1974 | Hall | 105/136 X |
| 3,877,388 | 4/1975 | Hall et al. | 105/136 X |

*Primary Examiner*—John J. Love
*Assistant Examiner*—Howard Beltran
*Attorney, Agent, or Firm*—Henry M. Bissell

[57] ABSTRACT

A system for suspending the traction motor and gear box of a parallel drive arrangement in a railway truck or the like in which the gear box and traction motor shafts are flexibly coupled together to accommodate relative movement between the two shafts. In addition, an arrangement is provided by which the mounting of the motor on the railway truck accommodates lateral displacement while the coupling between the traction motor housing and the gear box accommodates angular and offset misalignment of the coupled shafts.

23 Claims, 15 Drawing Figures

MOTORIZED RAILWAY TRUCK ARTICULATED SHAFT HOUSING

BACKGROUND OF THE INVENTION

1. Field of the Invention

This invention relates to electric drive propulsion units for railway cars or the like, and more particularly to the motor-to-drive gear coupling and suspension systems thereof.

2. Description of the Prior Art

Electrified railway cars of the type to which the present invention is applicable are of the parallel drive type and include street cars, transit or subway cars, and heavy commuter cars, to name a few. In such cars, each separate truck is typically provided with its own traction motor(s) and gear box drive arrangement(s). While such trucks may be constructed with their frame stringers either inside or outside the truck wheels, the present trend in the construction of railway cars in North America as well as elsewhere has been toward the use of inside frame trucks. It will be appreciated that this limits the space available for the mounting of the various drive components between the longitudinal frame sections or stringers and thus exacerbates problems relating to the misalignment of drive train shafts and accommodation of relative movement between individual components of the drive system.

It has been known in the prior art to rigidly mount the gear drive unit and the motor output shaft together with the gear box portion of the motor gear box assembly being coupled to the driving wheel axle. Such arrangements, however, have not been entirely satisfactory from the standpoint of operating lifetime and maintenance-free operation, due to the load of motor torque and the weight of the gear box assembly which are imposed on the resilient coupling between the drive gear and the driven axle.

Other propulsion systems of the prior art have avoided problems of a resilient coupling between the drive gear and the axle by solidly coupling the axle drive gear to the axle and providing resilient coupling between the gear box and the traction motor. Such an arrangement is disclosed in U.S. Pat. No. 3,468,389 of James A. Nelson.

Still another arrangement which combines the aforementioned resilient coupling between drive gear and axle with a resilient suspension system for the gear box assembly is disclosed in U.S. Pat. No. 3,841,228 of Walter O. Hall.

Still another system for resiliently mounting a traction drive suspension system is the subject of U.S. Pat. No. 3,877,388 of Walter O. Hall et al.

Such resilient mounting systems include pads, bushings or other elements of a resilient material which are subject to deterioration from the extreme load conditions imposed on them. However, according to the above-cited prior art patents, it has heretofore been considered essential to utilize resilient coupling in the drive train and/or resilient mounting of the drive system components in order to accommodate the relative movement of the various elements with respect to each other which is encountered in normal operation. Such relative movement results from unevenness of track and roadbed and from variations in the drive torque load and may involve vertical, longitudinal and lateral displacement as well as angular misalignment. While such relative movement may be comparatively slight, the forces involved are very substantial in view of the loads which are encountered in normal use.

SUMMARY OF THE INVENTION

In brief, arrangements in accordance with the present invention provide a traction motor drive system for an individual truck of a railway car or the like in which an electric traction motor and an axle drive gear box are mounted together and to the axle and truck frame with a controlled alignment coupling arrangement which effectively accommodates the relative movements between the gear box and motor and their respective intercoupled shaft elements which are encountered in normal operation of the vehicle.

In arrangements in accordance with the present invention, the gear box is hard-mounted to the axle, i.e. the driven gear is rigidly attached to the axle. The gear case is supported on the driven gear shaft by anti-friction bearings such that the forward weight of the gear box is carried by the axle. Since the gear box is rigidly attached to the axle, except as to rotation, the gear box must follow all vertical, lateral, longitudinal and angular motions of the axle. The wheelset, including the gear box (plus axle, wheels and journal bearings), moves in all three axes and angularly relative to the truck frame as the truck is subjected to variable loads in traversing an uneven track. This is controlled by the primary suspension located at each journal bearing which comprises springs such as coil or leaf springs or rubber half shells or chevron type springs. The rear end of the gear box is flexibly supported in the vertical axis only by a pendulum-like link hanging from a projection of the truck frame. Thus the rear end of the gear box is "sprung" weight being supported from the truck frame, whereas the forward end of the gear box and the actual running gear are unsprung weight.

The traction motor is suspended between the truck frame and the gear box. This is accomplished in such a manner that the motor shaft and the gear box pinion shaft remain as concentric as possible as the axle and gear box move relative to the truck frame. Where the frame is articulated for equalization, as it is in some designs, movements of the frame members relative to each other must also be compensated for, insofar as they effect the suspension of the traction motor and the rear end of the gear box from the truck frame.

The shaft coupling between the motor and the gear box is an assembly capable of allowing both angular and offset misalignment. The traction motor is suspended between the gear box and the truck frame.

In one particular arrangement in accordance with the invention, the suspension coupling between the traction motor housing and the gear box housing comprises a ball joint mechanism which serves to permit angular misalignment of the respective shafts but prevents offset misalignment thereof. The ball joint is designed so that its center of curvature is the coupling assembly between the motor and gear box shafts. The rear end of the traction motor is suspended from the truck frame by a pair of flexible links. These are flexibly arranged to provide angular and lateral freedom of movement of the traction motor while restraining it rotationally (providing the necessary torque reaction), vertically and longitudinally. [As used herein, the vertical, lateral and longitudinal axes refer to the railway car assembly; i.e. longitudinal is lengthwise of the car, lateral is across the car.]

In another particular arrangement in accordance with the present invention, the motor shaft coupling and the motor-to-frame support links are employed as discussed hereinabove, however, the ball joint support assembly previously described is replaced by a series of elastomeric O-rings disposed in suitably shaped grooves in inner and outer housings making up the motor-to-gear box support assembly. This last-mentioned support assembly is configured so as to permit the O-rings to roll under angular misalignment of the assembly, thus providing both increasing angular and lateral restraint versus displacement—i.e. an exponential spring rate—for good shock attenuation. These O-rings further provide a watertight seal protecting the coupling and also serve to provide an oil seal such that the motor coupling which is usually grease packed could run in oil.

Still other arrangements in accordance with the present invention incorporate a motor housing-to-gear box housing support assembly which combines a ball joint or elastomeric support coupling as described with a sliding support for increased lateral excursions. These variations make it possible to laterally fix the traction motor to the truck frame, thus isolating the motor from the severe lateral shocks developed by the axle. This may also improve the stability of the vehicle truck as the mass which must be accelerated laterally is reduced. In these arrangements, the rear support links for the traction motor are replaced by a bracket interface between the motor and the truck frame with a rubber shock mount between the brackets.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
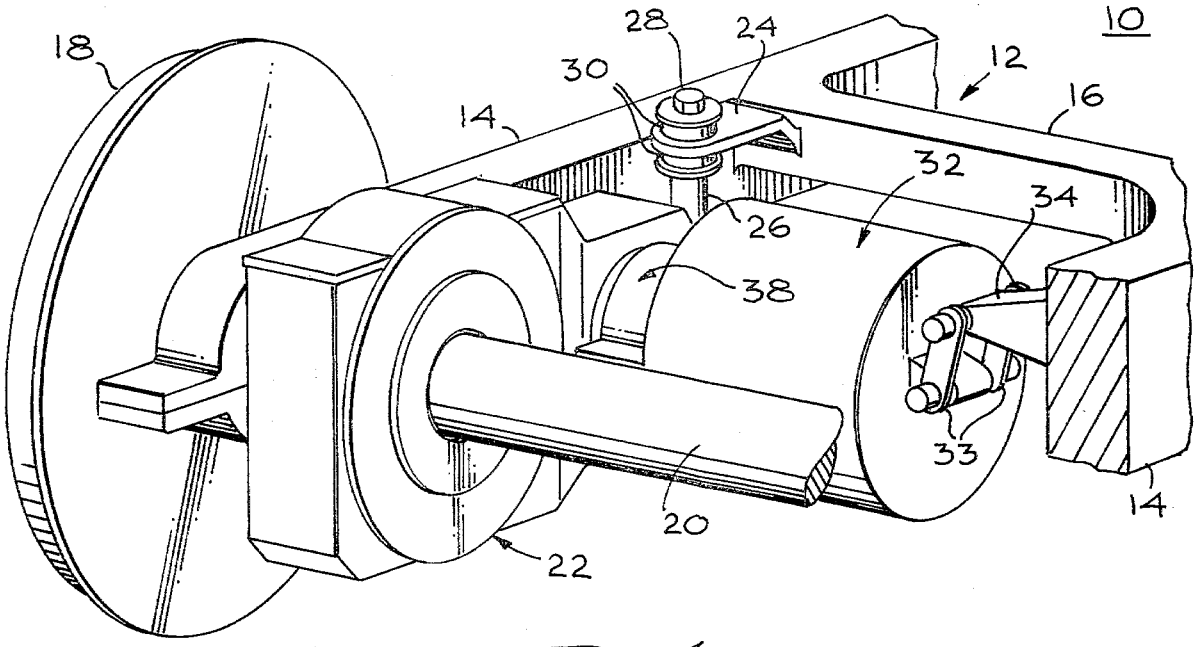
FIG. 1 is a perspective view, partially cut away, of a portion of a railway vehicle truck incorporating arrangements in accordance with the present invention.

FIG. 1 illustrates a drive system 10 for a railway vehicle in accordance with the present invention. FIG. 1, which is a partially broken away perspective view of a railway vehicle truck, shows the truck frame 12 comprising generally parallel longitudinal stringers or side rails 14 and orothogonal cross members 16. The running gear comprising wheels such as 18 and axles such as 20 is mounted via anti-friction bearings (not shown) in conventional fashion. A gear box 22 containing the drive gear which is attached to the axle 20 and a pinion gear coupled therewith, also in conventional fashion, is supported at its forward end on the axle by means of anti-friction bearings (not shown) and is suspended at its rearward end from a bracket 24, attached to the frame member 16, by means of a pendulum-type vertical support link 26. The link 26 is affixed to the bracket 24 by means of a nut 28 or similar fastening, and has bushings such as 30 which are mounted between a shoulder portion of the link 26 and on either side of the bracket 24 as a cushioning member and a vibration absorber. The lower end of the link 26 is connected to the gear case in similar fashion. A traction motor 32 has a housing which is supported at its rearward end by means of a pair of support links 33 connected to a bracket 34 which is mounted on the right-hand frame member 14. At its forward end, the housing of motor 32 is supported from the housing of the gear box 22 by means of a controlled alignment coupling arrangement 38.

Figure 4:
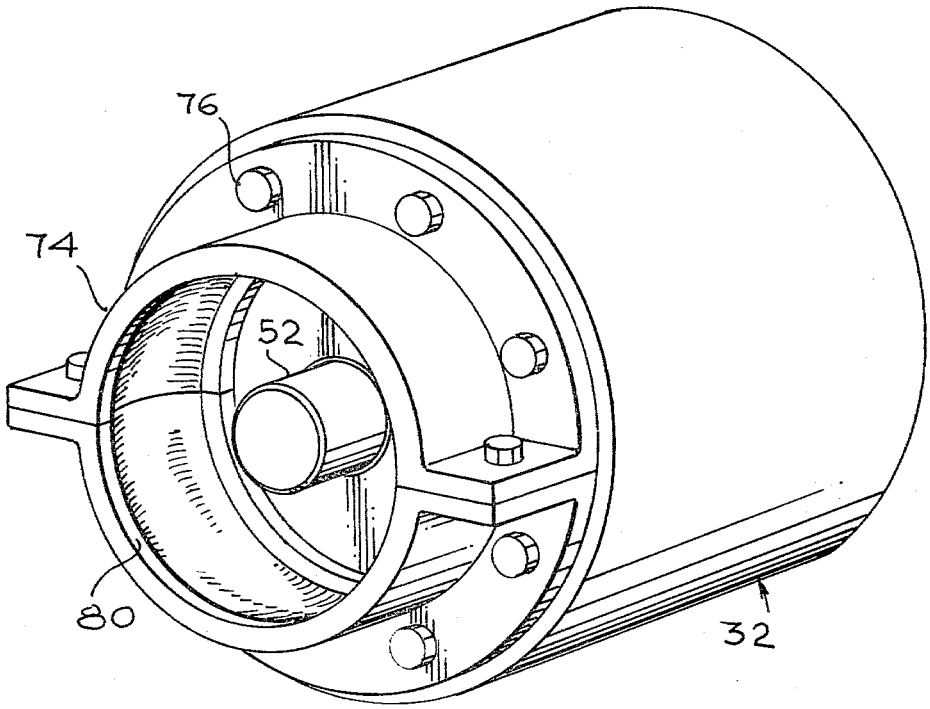
FIG. 4 is a perspective view illustrating the outer housing of the support coupling arrangement of FIG. 2.
Figure 3:
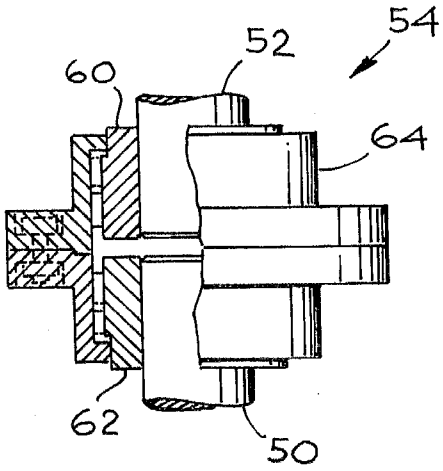
FIG. 3 is a view in partial section of a shaft coupling arrangement suitable for use with arrangements in accordance with the present invention.
Figure 2:
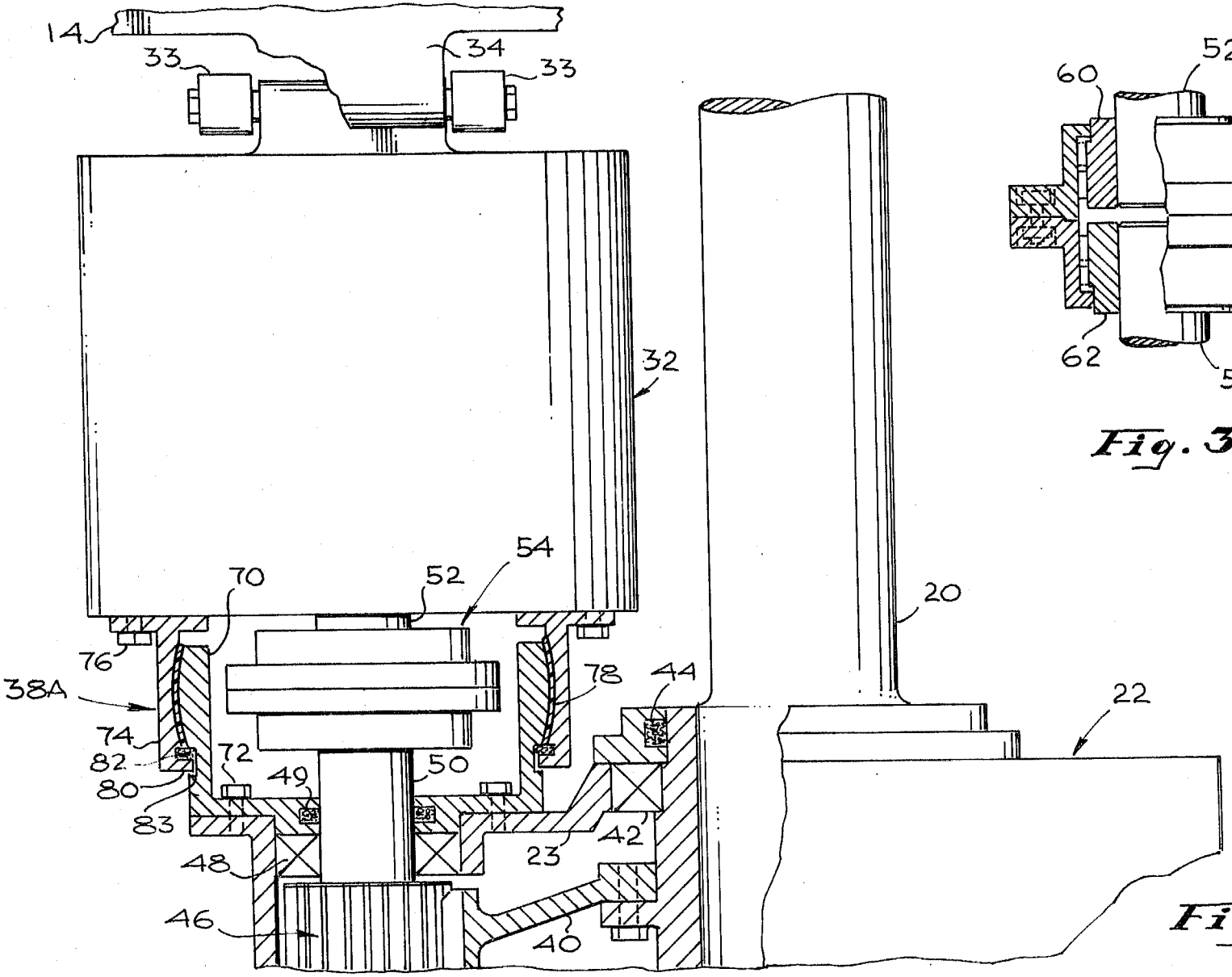
FIG. 2 is a plan view in partial section of one particular arrangement in accordance with the present invention.

Structural details of the controlled alignment coupling arrangement 38 comprising one particular arrangement in accordance with the invention are shown particularly in FIGS. 2–4. As particularly shown in FIG. 2, the driven gear 40 is attached to the axle 20 and the gear box 22 is supported on the axle 20 by means of bearings 42. A seal 44 is provided adjacent the bearings 42. The pinion or driving gear 46, also mounted in the gear box 22 by means of bearings 48, meshes with the driven gear 40. Another seal 49 is positioned adjacent the bearings 48.

The pinion gear 46 has a shaft 50 which is coupled to the output shaft 52 of the traction motor 32 by means of a double engagement type coupling 54. In the example of the double engagement type shaft coupling shown in FIG. 3, the coupling 54 is a three-element assembly capable of allowing both angular and offset misalignment. It principally comprises a motor shaft collar 60, a pinion gear shaft collar 62 and an outer housing 64. The outer surfaces of the collars 60, 62 are splined for sliding engagement within a correspondingly splined interior surface of the housing 64. As shown in FIG. 3, the housing 64 is split for ready assembly and disassembly and has end protrusions for maintaining the housing 64 in position on the collars 60, 62. Couplings of the type 54 shown in FIG. 3 are capable of up to 6° angular misalignment and small shaft offset. Offset of one shaft relative to the other tilts the center ring or housing 64 so that offset capability is directly related to angular misalignment capability. In general, short couplings as depicted in FIG. 3 are limited to 0.03 to 0.04 inches of offset.

The particular controlled alignment coupling 38A of FIG. 2 is a ball joint mechanism which serves to support the forward end of the motor 32 from the gear box 22. The ball joint 38A comprises three elements: an inner cylindrical ring 70 (the male part), shown affixed to the housing 23 of the gear box 22 by means of mounting bolts 72; an outer cylindrical ring 74 (the female part), shown attached to the housing of the traction motor 32 by means of mounting bolts 76; and a liner 78 of rubber, Teflon or some other suitable friction-reducing material, preferably self-lubricating, to facilitate sliding or elastomeric motion between the two rings 70, 74.

As shown more particularly in FIG. 4, the outer cylindrical ring 74 is split for assembly and maintenance purposes and has an interior concave spherical surface for engaging the outer convex spherical surface of the inner ring 70. The centers of curvature of the mating surfaces of the inner and outer rings 70, 74 are on the rotational and lengthwise centers of the coupling 54 and are coincident with the geometric center of the coupling and in line with the axes of the shafts 50, 52 when the shafts are in alignment. The outer cylindrical ring or housing 74 includes an inwardly protruding lip 80 loosely engaging a groove 83 in the inner ring 70 for the purpose of providing a positive lateral stop in the event of severe loading and/or joint failure.

Figure 6:
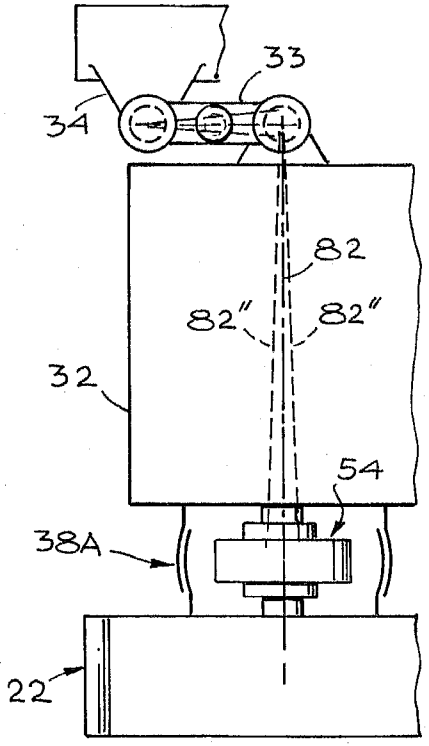
FIG. 6 is an elevational schematic view illustrating the motor support assembly of the arrangement of FIG. 2.
Figure 5:
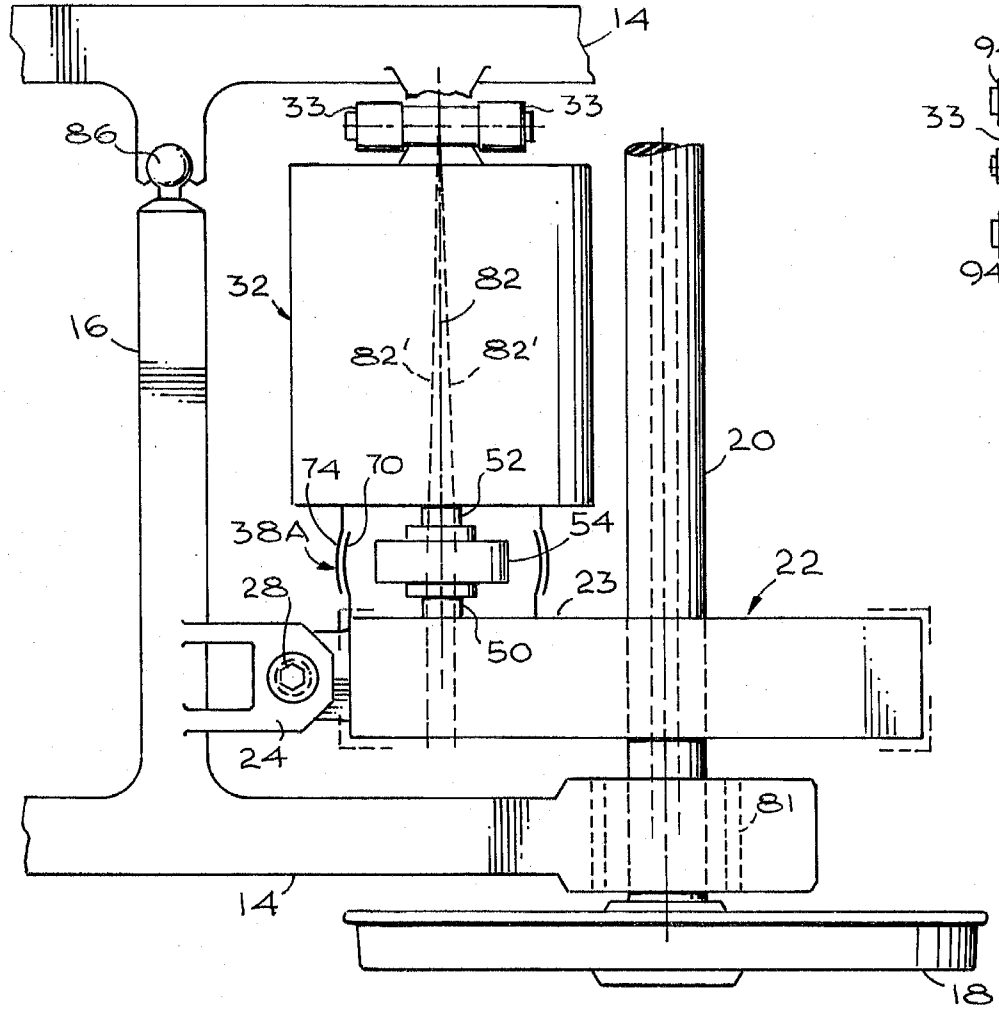
FIG. 5 is a schematic plan view, partially broken away, of a variation of the arrangement of FIG. 2.

The operation of the suspension and coupling arrangement 38A of FIGS. 2–4 is illustrated in the schematic views of FIGS. 5 and 6, a plan view and a partial elevation view, respectively. As seen in FIG. 5, which illustrates longitudinal excursion due to longitudinal motion of the wheel 18 and axle 20 relative to the frame member 14 by virtue of the resilience of the suspension member 81, the movement of the rear end of the motor 32 is constrained by the vertical support links 33. However, the angular misalignment (shown to an exaggerated degree) of the center line 82 of the motor 32, coincident with the center line of the shaft 52, is relative to the center line of the pinion gear 50 which shifts in the opposite direction. As the center line 82 of the motor 32 shifts to one side or the other as shown by the broken lines 82', the angular misalignment with the shaft 50 becomes severe. The corresponding misalignment between the motor housing 32 and the housing 23 of the gear box 22 is accommodated by the ball joint support arrangement 38A as the inner ring 70 pivots relative to the outer ring 74. Such angular misalignment may be more severe in a truck of the type depicted in FIG. 5 which comprises a split cross-member 16 joined by a ball joint 86.

Similar angular misalignment is illustrated schematically in FIG. 6, an elevational schematic view in which the vertical motion of the gear box 22 and motor 32 is exaggerated. In this plane, the assembly comprising the support links 33 permits pivotable movement of the motor 32 about the pivot axes at the ends of the links 33. Thus, the longitudinal axis 82 of the motor 32 pivots between broken lines 82''. Such angular misalignment with the gear box 22 is accommodated by the ball joint structure 38A.

Figure 7:
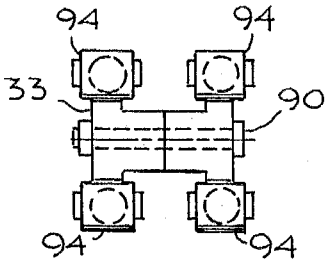
FIG. 7 is an elevational view of the support link of FIG. 6.

Details of the assembly of the rear support links 33 are shown in FIG. 7. In this figure, the support links 33 are fastened together by a pin 90. The ends 94 of the links 33 are fitted with a ball joint of either the metal-to-metal type or a spherical joint with a Teflon or rubber interlayer for shock and/or noise attenuation. Depending upon the motion to be accommodated from the truck frame, rubber bushes may be used. The lower ends of the links 33 attach to the end bell or frame of the motor 32, while the upper ends are pivotably connected to a support on the truck frame, such as the bracket 34.

Figure 9:
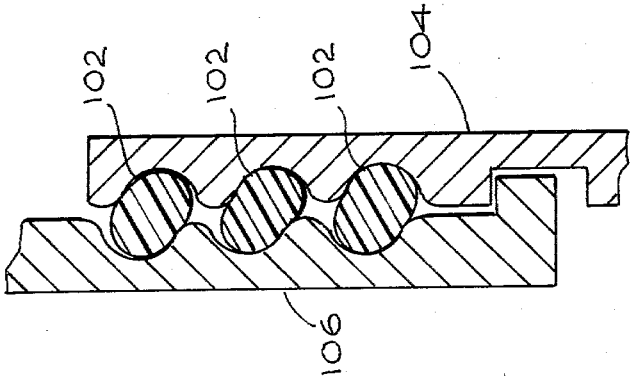
FIG. 9 is a schematic view of a portion of the arrangement of FIG. 8 illustrating the effect of lateral displacement.
Figure 8:
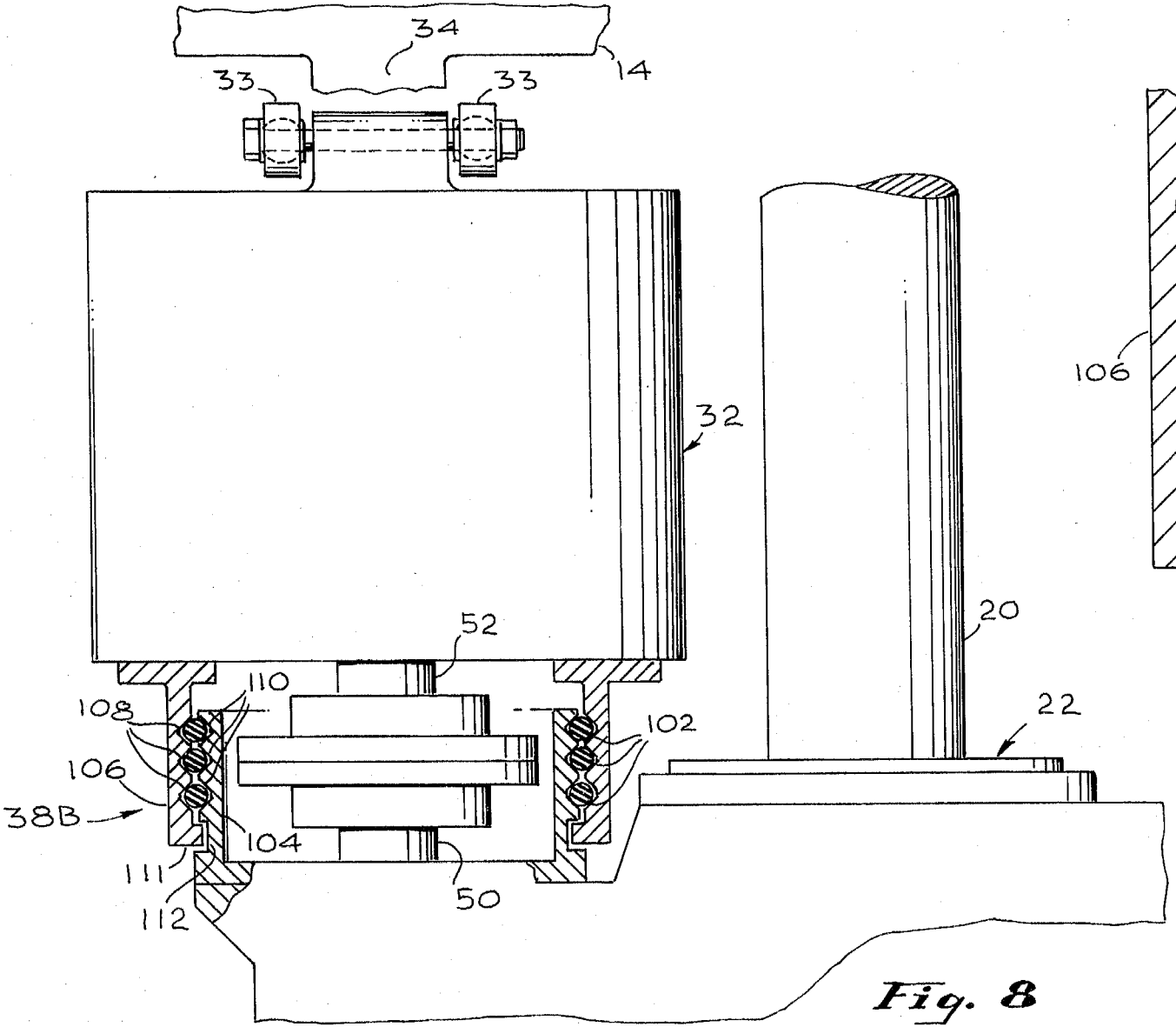
FIG. 8 is a plan view in partial section of an alternative arrangement in accordance with the present invention.

FIGS. 8 and 9 illustrate a second arrangement in accordance with the invention. In this arrangement, the motor 32 is supported at its rear from the truck frame 14 by a pair of link members 33 as described hereinabove. At its forward end, the traction motor 32 is supported from the gear box 22 by means of a controlled alignment coupling 38B. In this arrangement, the coupling between the motor shaft 52 and the pinion gear shaft 50 is the same as was previously shown and described, particularly with respect to FIG. 3. In place of the ball joint support 38A of FIG. 2, however, the support assembly 38B comprises a series of elastomeric O-rings 102 disposed in suitable shaped grooves in the inner housing 104, attached to the gear box 22, and the outer housing 106, attached to the traction motor 32. The outer housing 106 may resemble the split outer housing or ring 74 of FIG. 4, except that instead of the interior concave spherical surface of the ball joint outer ring, a series of grooves 108 would be arrayed along the interior of the housing. As illustrated in FIG. 8, three O-rings 102 in V-shaped outer grooves 108 and inner grooves 110 are used. The V-shaped grooves 108 and 110 are so shaped as to allow the rings 102 to roll under angular misalignment of the assembly 38B. The greater the misalignment, the greater the resistance which is provided by the O-rings 102, thus resulting in an effective exponential spring rate for good shock attenuation. FIG. 9 illustrates the distortion of the O-rings 102 under extreme angular misalignment and resulting displacement of the inner ring 104 and outer ring 106. As shown in FIG. 8, the outer ring is provided with an inwardly protruding lip 111 loosely engaging a groove 112 in the inner ring 104 to provide a positive lateral stop in the event of severe loading and/or joint failure.

In addition to providing the exponential spring rate in opposition to increased angular misalignment of the elastomeric support arrangement 38B of FIG. 8, this arrangement also provides a further benefit of economy of fabrication. This structural configuration permits liberal manufacturing tolerances of the mating parts (the inner and outer housings or rings 104, 106) by virtue of the elastomeric rings 110 which are mounted between the housings and separate them from actual contact.

Figure 11:
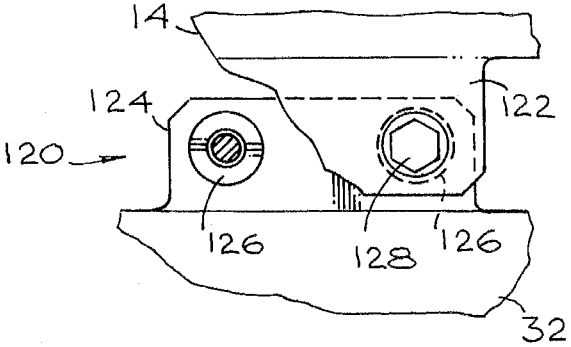
FIG. 11 is a side elevation, partially broken away, of a portion of the arrangement of FIG. 10.
Figure 10:
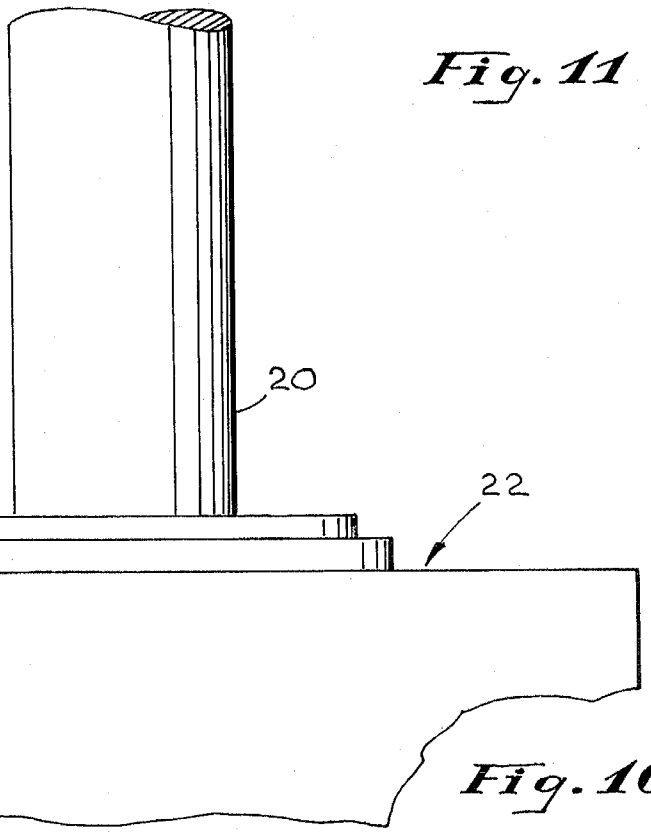
FIG. 10 is a plan view in partial section and partially broken away of still another arrangement in accordance with the present invention.

FIG. 10 is a plan view, partially broken away, of a further particular embodiment of the present invention and FIG. 11 is a side view, partially broken away, of the rear mount for the traction motor thereof. In these figures, the support arrangement comprising the links 33 is replaced with an arrangement 120 which laterally fixes the traction motor 32 to the truck frame 14. Such an arrangement has the advantage of isolating the motor 32 from the severe lateral shock encountered from the axle 20, and it may also improve the stability of the truck as less mass is required to be accelerated laterally. The support mechanism comprises a bracket interface between the motor 32 and the truck frame 14 in the form of a frame bracket 122 and a motor bracket 124 with a rubber shock mount 126 inbetween. Mounting bolts 128 are provided to hold the mount together. Since the motor 32 is restrained against lateral movement, the increased excursion of the gear box relative to the motor 32 is accommodated by a combination spherical or ball joint and sliding support 130 (FIG. 10). The support 130 is similar to the ball joint support arrangement of FIG. 2 in that it comprises an outer ring 132 with inner concave spherical surface, an inner ring 134 with outer convex spherical surface, both surfaces having their center at the center of the coupling 154, and a liner 136 of rubber, Teflon or other suitable material between the two rings 132, 134. In addition, however, the inner ring 134 is mounted in slidable relationship on an inner support collar 138 mounted on the gear box 22. This slidable relationship of the inner ring 134 relative to the collar 138 which is affixed to the gear box 22 accommodates the increased lateral excursion that occurs between the gear box 22 and the motor 32 when the motor is mounted to the frame 14 at the rearward end in the fashion shown by means of the mounting mechanism 120. Travel limiting protrusions 140 are provided at the inboard and outboard ends of the collar 138 to provide a positive lateral stop in the event of severe displacement and/or joint failure.

Figure 10A:
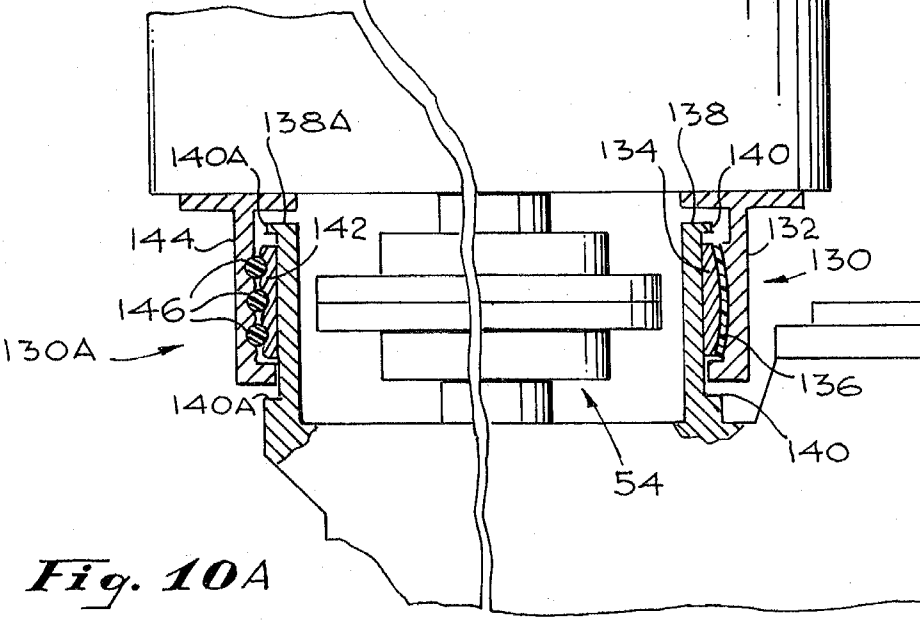
FIG. 10A is a partial view of an arrangement like that of FIG. 10 but utilizing a structural feature of FIG. 8.

FIG. 10A shows a corresponding support coupling 130A similar to the elastomeric support arrangement of FIG. 8, but with the addition of a sliding inner ring 142 which is slidable on the inner collar 138A. In FIG. 10A, the elastomeric portion of the support mechanism 130A is provided by the inner grooved ring 142, an outer grooved ring 144 and a series of elastomeric O-rings 146. As with the support coupling 130 of FIG. 10, the inner collar 138A has protrusions 140A at its inboard and outboard ends to provide a positive lateral stop in the event of severe excursions and/or joint failure.

Figure 12:
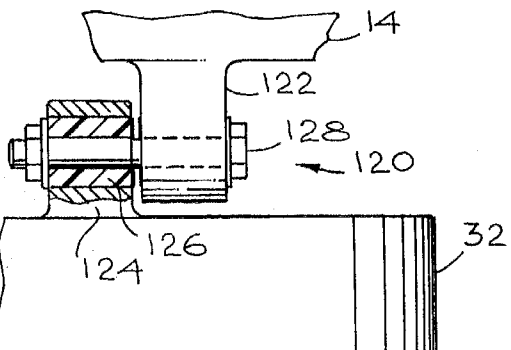
FIG. 12 is a view of an alternative mounting assembly which may be used in the arrangement of FIG. 10.
Figure 12:
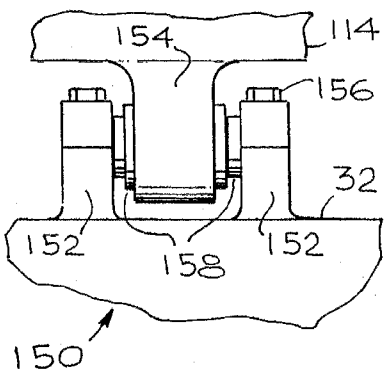

FIG. 12 shows an alternative rear mounting 150 which may be used in place of the mount 120 in FIG. 10. In this arrangement, a pair of brackets 152 are affixed to the frame of the motor 32 and are secured to a bracket 154 attached to the frame 114 by means of bolts 156 and bushings 158.

Figure 13:
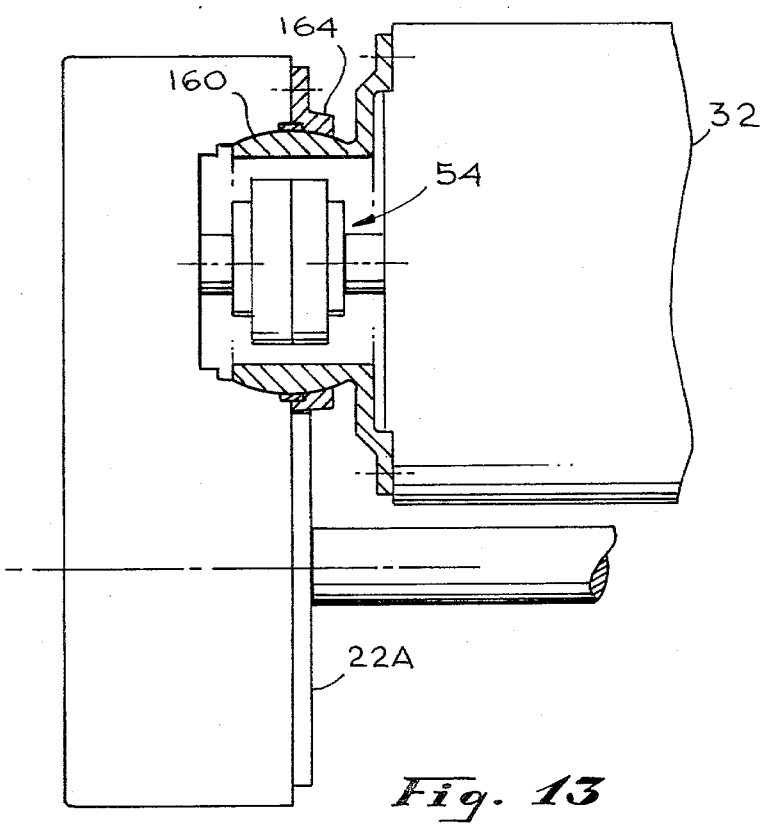
FIG. 13 is a plan view, in partial section and partially broken away, of a variant of the arrangement of FIG. 2.
Figure 14:
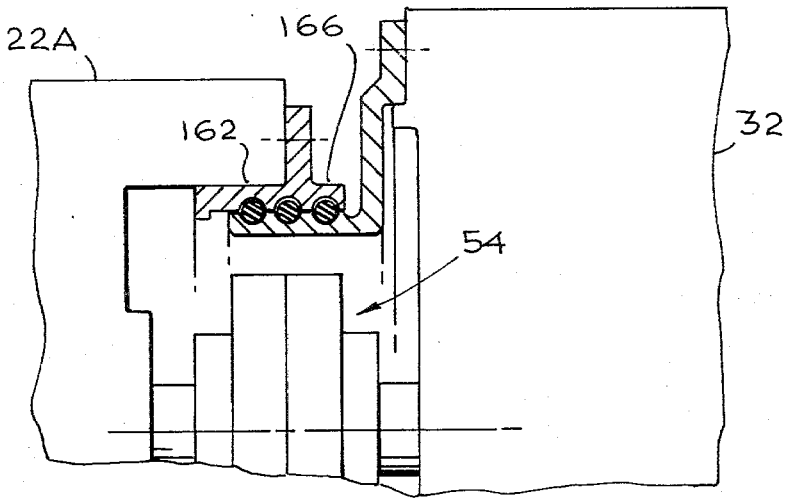
FIG. 14 is a plan view, in partial section and partially broken away, of a variant of the arrangement of FIG. 8.

FIGS. 13 and 14 depict the motor-to-gear box suspension arrangements in accordance with the present invention in use with a different form of gear box, in common use at present, where the coupling is approximately one-half buried or recessed in the inboard face of the gear box. Thus, a gear box 22A is shown with a shorter pinion gear and with the pinion shaft recessed inwardly from the inboard face of the gear box 22A. In such an arrangement, the outer member of the support coupling, either the concave interior surface 160 of the ball joint support of FIG. 13 or the outer grooved ring 162 of the elastomeric support of FIG. 14 may be formed integrally with the casing of the gear box 22A. A closure or retainer 164 (FIG. 13) removably mounted on the gear box 22A, may complete the outer ring member of the ball joint support. As shown in FIG. 14, the retainer 166 secured to the casing of the gear box 22A also extends inwardly of the gear box recess to provide the outer grooved ring 162.

As are shown and described hereinabove, the motor support arrangements in accordance with the present invention eliminate the necessity for the resilient mounting arrangements between the traction motor and the gear box or which are employed elsewhere in the drive train of prior art apparatus. As a result, a more effective support is provided which is more reliable and maintenance-free by virtue of its freedom from dependence upon resilient coupling or drive members at those points where the most extreme torque and vibration loads are encountered. The above-described arrangements in accordance with the present invention also demonstrate an improved capability in accommodating shaft misalignment between the motor drive shaft and the pinion gear driven shaft resulting from normal operation of the vehicle on which such systems are mounted.

Although there have been described above specific arrangements of traction motor and gear box suspension systems in accordance with the invention for the purpose of illustrating the manner in which the invention may be used to advantage, it will be appreciated that the invention is not limited thereto. Accordingly any and all modifications, variations or equivalent arrangements which may occur to those skilled in the art should be considered to be within the scope of the invention as defined in the annexed claims.

What is claimed is:

1. A railway motor mounting system comprising:

a truck frame supported on a wheel and axle set;

a gear box comprising a plurality of gears in a drive train coupled to directly drive the axle, said plurality including a pinion gear having an input shaft positioned adjacent one end of the gear box and connected to a drive gear attached to the axle;

means supporting said one end of the gear box from the truck frame, the other end being supported on the axle by anti-friction bearings;

a traction motor having a housing and an output shaft parallel to the axle and flexibly coupled to drive the pinion gear shaft;

first motor support means mounting the rearward end of the motor housing remote from said output shaft to the truck frame; and second motor support means mounting the forward end of the motor housing adjacent the output shaft to the gear box, said second support means comprising a flexible joint surrounding said shafts and extending between the gear box and the housing of the traction motor.

2. Apparatus in accordance with claim 1 wherein said joint comprises an outer cylindrical housing member and an inner cylindrical housing member, said members overlapping each other and being attached, one to the traction motor and one to the gear box, and further includes spacing means positioned in the region of overlap between the inner and outer cylindrical members for facilitating relative movement between them.

3. The apparatus of claim 2 wherein said outer housing member is bifurcated for ease of assembly and disassembly.

4. The apparatus of claim 2 wherein the outer housing member is affixed to the motor and the inner housing member is affixed to the gear box.

5. The apparatus of claim 2 wherein the joint is a ball joint, the outer housing member having a curved concave inner surface, the inner housing member having a curved convex outer surface, the centers of curvature of said surfaces being coincident with the geometric center of the flexible joint and in line with the axes of said coupled shafts when the shafts are in alignment.

6. The apparatus of claim 5 wherein the spacing means comprises a resilient liner extending between said surfaces.

7. Apparatus in accordance with claim 5 wherein the spacing means comprises a friction-reducing liner extending between said surfaces to facilitate relative motion therebetween.

8. The apparatus of claim 2 wherein the outer housing member has a grooved inner surface with a plurality of circumferential grooves therein; wherein the inner housing member has a grooved outer surface with a like plurality of circumferential grooves therein; and wherein the spacing means comprises a like plurality of O-rings mounted in the grooves of said inner and outer members.

9. The apparatus of claim 8 wherein the grooves are V-shaped and said O-rings are of an elastomeric material to develop an exponential spring rate with respect to displacement of the housing members relative to each other.

10. The apparatus of claim 1 wherein the first motor support means comprises a first bracket affixed to the motor, a second bracket affixed to the frame, and a pair of links connecting between said brackets.

11. The apparatus of claim 10 wherein said links are vertically oriented in parallel to permit lateral movement of the motor relative to the frame and angular displacement about said links while limiting rotational and other movement of the motor.

12. The apparatus of claim 10 wherein the ends of said links connect to said brackets through individual ball joints to permit limited pivoted movement of the motor relative to the frame.

13. The apparatus of claim 1 wherein the first support means inclues means fixing the motor against lateral movement relative to the frame and wherein the second support means comprises a combination of a slidable coupling operable with the flexible joint.

14. The apparatus of claim 13 wherein said combination comprises a first outer cylindrical member, a second intermediate cylindrical member within and partially overlapping the first member, a third inner cylindrical member supporting said second member in sliding relationship, and spacing means mounted between the first and second members in the region of overlap thereof.

15. The apparatus of claim 14 wherein the third member includes outwardly extending protrusions on opposite sides of the second member for limiting the excursion of the second member relative to the third member.

16. The apparatus of claim 14 wherein the joint is a ball joint with the first and second members having mating curved adjacent surfaces on opposite sides of the spacing means with a common center of curvature coincident with the geometric center of the joint and in line with the axes of said shafts when the shafts are in alignment.

17. The apparatus of claim 14 wherein said joint is an elastomeric coupling with the first and second members having adjacent sufaces with matching circumferential grooves therein, and wherein the spacing means comprises a plurality of O-rings positioned in respective ones of said grooves.

18. The apparatus of claim 1 wherein said shafts are joined together in torque-transmitting relationship by a double engagement splined coupling capable of allowing both angular and offset misalignment of the shafts relative to each other.

19. The apparatus of claim 18 wherein the flexible joint between the traction motor and the gear box includes means for permitting offset alignment of the two shafts.

20. The apparatus of claim 1 wherein the first motor support means comprise a first bracket attached to the motor, a second bracket attached to the trunk frame, and a resilient shock mount engaged between the two brackets.

21. The apparatus of claim 1 wherein a portion of said flexible joint is recessed into the gear box in the region adjacent the motor.

22. A coupling assembly between a motor having a housing and an output shaft and a gear box having an input shaft, the two shafts being coupled together in driving relationship, wherein the gear box supports the shaft end of the motor and is subject to excursionary movements tending to develop angular and offset misalignments of said shafts relative to each other, the assembly comprising:

a first flexible torque-transmitting coupling connected between the two shafts;

a second flexible support coupling extending about the first coupling and having a pair of mating members, one being affixed to the gear box and the other being affixed to the motor housing, adapted to accommodate relative angular and offset movements of one member with respect to the other, said members comprising concentric cylindrical housings having a region of overlap and having matching circumferential grooves in respective adjacent surfaces in the region of overlap; and a plurality of elastomeric O-rings, one in each of said grooves.

23. The assembly of claim 22 wherein one of said members comprises an outer cylindrical housing and the other member comprises an inner cylindrical housing, said members overlapping each other in an intermediate region between their respective distal portions, and further including spacing means extending between the first and second members in the intermediate region.

* * * * *